US007797961B2

(12) United States Patent
An et al.

(10) Patent No.: US 7,797,961 B2
(45) Date of Patent: Sep. 21, 2010

(54) REFRIGERATOR HAVING IMPROVED ICE-MAKING UNIT CONFIGURATION

(75) Inventors: Jae-koog An, Gwangju (KR); Keon-ho Hong, Fairfax, VA (US)

(73) Assignee: Samsung Electronics Co., Ltd., Suwon-Si (KR)

( * ) Notice: Subject to any disclaimer, the term of this patent is extended or adjusted under 35 U.S.C. 154(b) by 285 days.

(21) Appl. No.: 11/898,051

(22) Filed: Sep. 7, 2007

(65) Prior Publication Data

US 2008/0134710 A1 Jun. 12, 2008

(30) Foreign Application Priority Data

Dec. 7, 2006 (KR) ..... 10-2006-0123991

(51) Int. Cl.
*F25C 1/00* (2006.01)
*F25C 5/18* (2006.01)
*F25C 5/02* (2006.01)

(52) U.S. Cl. ..... 62/353; 62/344; 62/320

(58) Field of Classification Search ..... 62/353, 62/344, 320
See application file for complete search history.

(56) References Cited

U.S. PATENT DOCUMENTS

| | | | | |
|---|---|---|---|---|
| 3,727,425 | A * | 4/1973 | Kesling | 62/346 |
| 6,082,130 | A * | 7/2000 | Pastryk et al. | 62/344 |
| 6,438,987 | B1 * | 8/2002 | Pahl | 62/342 |
| 7,040,111 | B2 * | 5/2006 | Lee et al. | 62/344 |
| 2004/0237565 | A1 * | 12/2004 | Lee et al. | 62/344 |
| 2006/0201189 | A1 * | 9/2006 | Adamski et al. | 62/334 |

* cited by examiner

*Primary Examiner*—Frantz F. Jules
*Assistant Examiner*—Cassey Bauer
(74) *Attorney, Agent, or Firm*—Staas & Halsey LLP

(57) ABSTRACT

Provided is a refrigerator including a main body cabinet forming a storage compartment; a door operable to open and close the storage compartment; an ice tray provided in the door and capable of making ice cubes; and an ice storage container receiving the ice cubes made by the ice tray, and having an ice outlet formed in a lower part thereof and a rear wall surface forming an angle of inclination with respect to a level surface.

14 Claims, 9 Drawing Sheets

REFRIGERATOR HAVING IMPROVED ICE-MAKING UNIT CONFIGURATION

CROSS-REFERENCE TO RELATED APPLICATIONS

This application claims priority from Korean Patent Application No. 2006-0123991, filed on Dec. 7, 2006, in the Korean Intellectual Property Office, the disclosure of which is incorporated herein by reference.

BACKGROUND

1. Field of the Invention

Apparatuses and methods consistent with the present invention relate to a refrigerator, and more particularly, to a refrigerator which improves a configuration of an ice-making unit.

2. Description of the Related Art

A refrigerator stores various foods for a long time by using cooling air generated by a cooling cycle. Generally, the refrigerator includes a freezing compartment which stores frozen foods, such as meat and fish, at a temperature bottom than a freezing temperature, and a refrigerating compartment which stores foods, such as fruits and vegetables, at a temperature above the freezing temperature. A freezing compartment door is attached to a front side of the freezing compartment, while a refrigerating compartment door is attached to a front side of the refrigerating compartment.

Recently, a refrigerator which includes an ice-making unit and a dispenser in a freezing compartment door has been developed. FIGS. 1 and 2 illustrate freezing compartment doors 100 and 200 of conventional refrigerators which include ice-storage units 110 and 210 and dispensers 160 and 260. The ice-storage units 110 and 210 are provided in an inner upper part of the freezing compartment doors 100 and 200 of the conventional refrigerators. The dispensers 160 and 260 are provided outside the freezing compartment doors 100 and 200 to supply ice stored by the ice-storage units 110 and 210 to the outside.

As shown in FIG. 1, a conventional refrigerator includes an ice storage container 120 which has an ice outlet provided in a lateral side thereof to discharge ice cubes, an ice mover 130 which moves the ice cubes stored in the ice storage container 120 to the ice outlet, an ice shredder 140 which shreds the ice cubes supplied from the ice storage container 120 into pieces, and a driver 150 which drives the ice mover 130 and the ice shredder 140.

Such a conventional refrigerator has the ice storage container 120 whose lengthwise direction is disposed horizontally in a front-rear direction to take a relatively large space in a storage compartment. As the ice shredder 140 and the driver 150 are provided in a lateral side of the ice storage container 120, the capacities of the ice storage container 120 and the storage compartment decrease correspondingly. Also, the ice storage container 120 is provided horizontally, thereby failing to provide ice uniformly.

As shown in FIG. 2, a conventional refrigerator includes an ice storage container 220 which has an ice outlet in a bottom surface thereof to discharge ice cubes, a shaking lever 230 which shakes the ice cubes stored in the ice storage container 220, an ice shredder 240 which is provided in a bottom part of the ice storage container 220 to shred the ice cubes supplied from the ice storage container 220 into pieces, and a driver 250 which drives the shaking lever 230 and the ice shredder 240.

Such a conventional refrigerator has the ice storage container 220 which is vertically provided and increases the capacity of the ice storage container 220. However, the shredded ice piles up in an outlet path if the shredded ice is not discharged. Also, the ice cubes are discharged through the ice outlet by gravity, thereby making the amount of the ice discharged not uniform.

SUMMARY

Accordingly, it is an aspect of the present invention to provide a refrigerator which improves spatial efficiency of a storage compartment by using a dead space of the storage compartment, increases a capacity of an ice storage container and makes the amount of ice supplied to a dispenser uniform.

Additional aspects and/or advantages of the present invention will be set forth in part in the description which follows and, in part, will be obvious from the description, or may be learned by practice of the present invention.

The foregoing and/or other aspects of the present invention are also achieved by providing a refrigerator including a main body cabinet forming a storage compartment; a door operable to open and close the storage compartment; an ice tray provided in the door and capable of making ice cubes; and an ice storage container receiving the ice cubes made by the ice tray, and having an ice outlet formed in a lower part thereof and a rear wall surface forming an angle of inclination with respect to a level surface.

According to an aspect of the invention, the angle of inclination ranges from 20° to 60°.

According to an aspect of the invention, the rear wall surface of the ice storage container is downwardly inclined to the ice storage compartment.

According to an aspect of the invention, the refrigerator further includes at least one rotating blade rotatingly moving the ice cubes discharged to the ice outlet; a supporting blade shredding the ice cubes moved by the rotating blade, in cooperation with the at least one rotating blade; and a driver including a gear assembly having a rotating shaft connected with a lower part of the at least one rotating blade and transmitting a driving force to the rotating blade, and a driving motor provided in a side of the gear assembly and supplying a driving force to the gear assembly.

According to an aspect of the invention, the rotating blade and the supporting blade are provided in parallel with an angle of the rear wall surface of the ice storage container.

According to an aspect of the invention, the refrigerator further includes a shaking lever bent from the rotating shaft and extending inside of the ice storage container, and shaking the ice cubes stored in the ice storage container.

According to an aspect of the invention, the refrigerator further includes an ice mover connected with the rotating shaft and moving the ice cubes stored in the ice storage container to the ice outlet.

According to an aspect of the invention, the ice mover includes a moving rotation shaft extending from the rotating shaft, and a spiral blade spirally formed along a circumference of the moving rotation shaft.

According to an aspect of the invention, the refrigerator further includes a blade accommodator accommodating the rotating blade and the supporting blade, and having an ice discharging opening having a first side that is open; and a discharging lever rotatably provided in the blade accommodator and opening and closing the ice discharging opening.

According to an aspect of the invention, the blade accommodator and the discharging lever are provided in parallel with the inclined rear wall surface of the ice storage container.

The foregoing and/or other aspects of the present invention are also achieved by providing an ice providing device, including an ice making device making ice cubes; and an ice storage container receiving the ice cubes made by the ice making device, the ice storage container having an ice outlet formed in a lower part of the ice storage container and a rear wall surface of the ice storage container and having an angle of inclination with respect to a level surface.

BRIEF DESCRIPTION OF THE DRAWINGS

The above and/or other aspects of the present invention will become apparent and more readily appreciated from the following description of the embodiments, taken in conjunction with the accompanying drawings of which.

DETAILED DESCRIPTION

Figure 1:
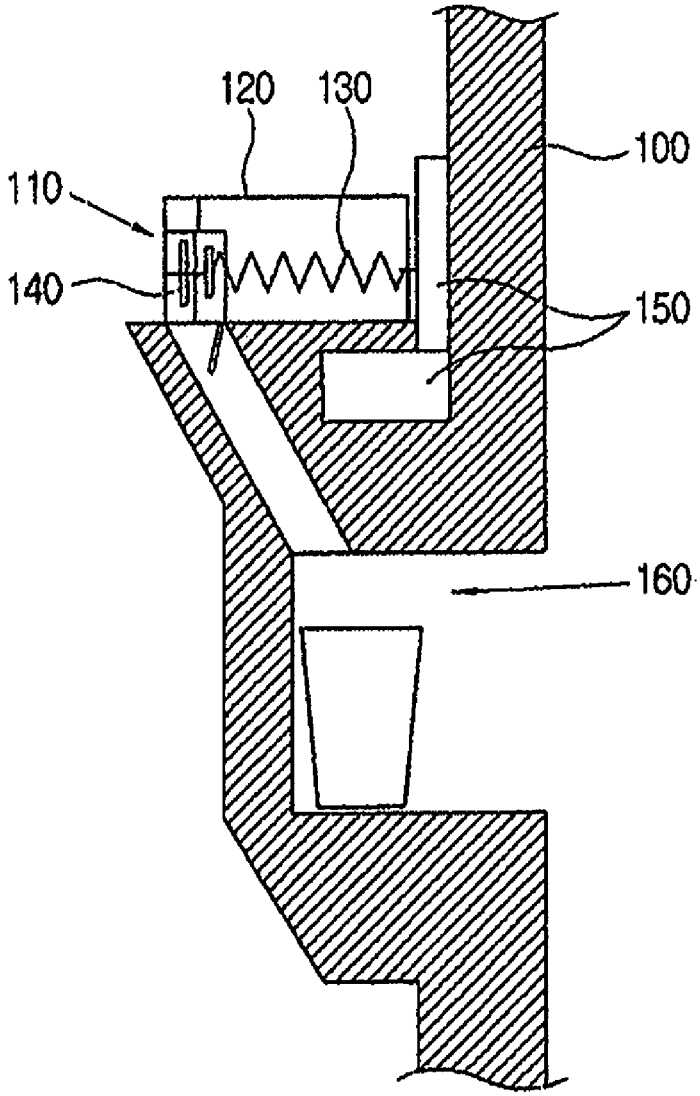
FIG. 1 (RELATED ART)
FIG. 1 illustrates a freezing compartment door of a conventional refrigerator which has an ice-storage unit and a dispenser in the freezing compartment door.
Figure 2:
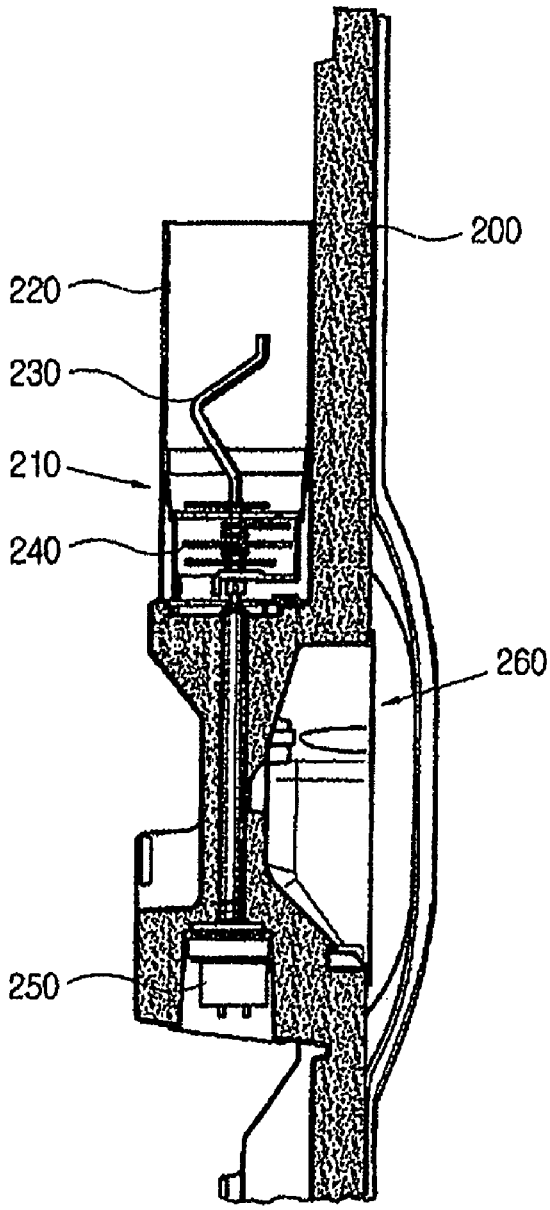
FIG. 2 (RELATED ART)
FIG. 2 illustrates a freezing compartment door of a conventional refrigerator which has an ice-storage unit and a dispenser in the freezing compartment door.
Figure 3:
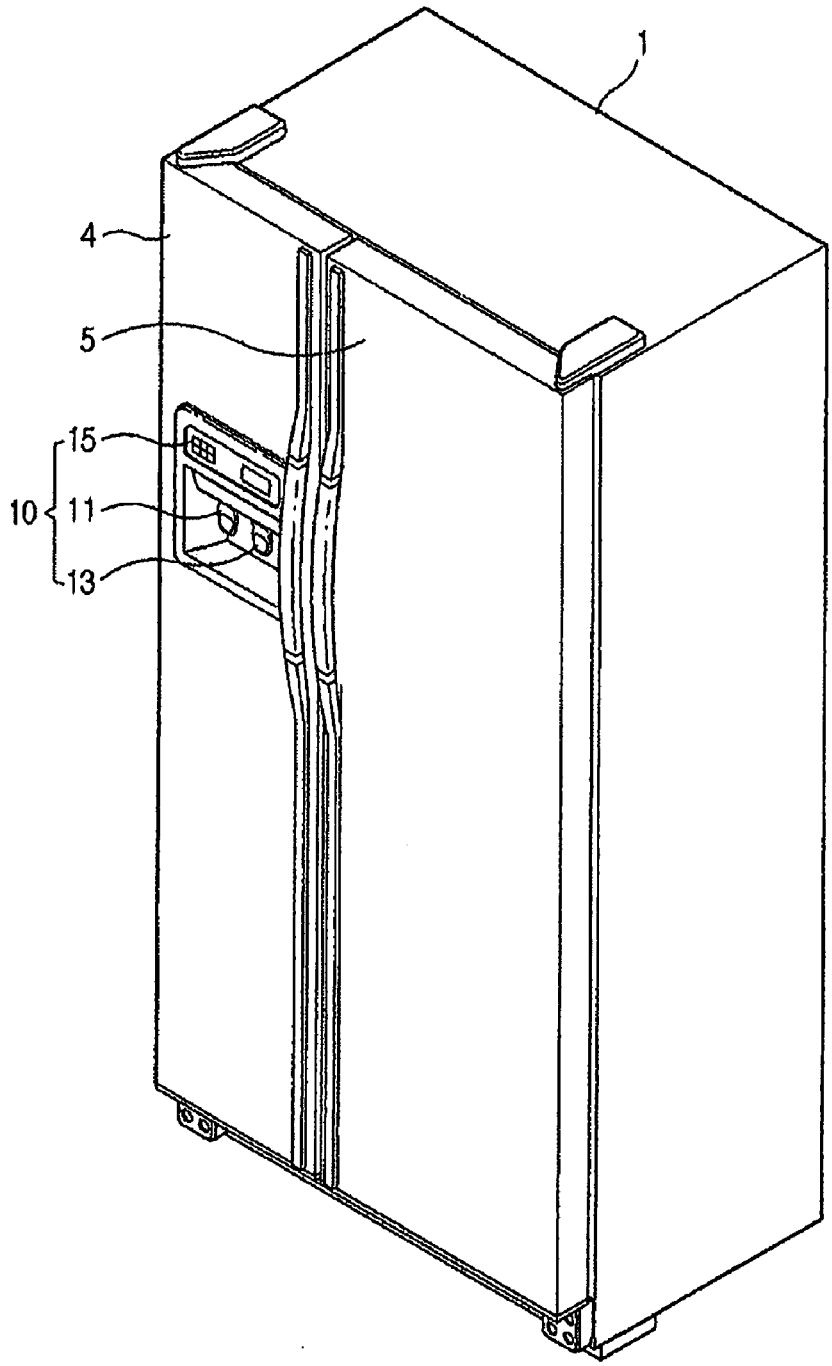
FIG. 3 is a perspective view of a refrigerator according to the present invention.

Hereinafter, embodiments of the present invention will be described with reference to accompanying drawings, wherein like numerals refer to like elements and repetitive descriptions will be avoided as necessary. A side-by-side type refrigerator of which a storage compartment is provided as a pair of right and left sides will be described as an example of the present invention. Alternatively, the present invention may be applicable to a top-mounted freezer (TMF) of which compartments are provided on upper and lower parts thereof and whose freezer is provided on top thereof, and a bottom-mounted freezer (BMF) of which a refrigerating compartment is provided on top thereof. If the present invention is applicable to the BMF-type refrigerator, an ice-making unit is provided in a refrigerating compartment door.

A refrigerator according to a first embodiment of the present invention includes a main body cabinet 1 having a storage compartment (not shown), doors 4 and 5 to open and close the storage compartment, and an ice-making unit which is provided in the doors 4 and 5.

The storage compartment is provided to be partitioned in the main body cabinet 1. The storage compartment is divided into a left side and a right side, e.g., a freezing compartment and a refrigerating compartment, by an intermediate wall. A freezing compartment door 4 and a refrigerating compartment door 5 are provided in a front opening of the freezing compartment and the refrigerating compartment to open and close the opening of the freezing compartment and the refrigerating compartment.

The ice-making unit is provided inside of the freezing compartment door 4 to make and store ice. A dispenser 10 is provided outside of the freezing compartment door 4 to dispense ice made and stored in the ice-making unit and drinking water. The ice-making unit and the dispenser 10 communicate with each other through an ice duct 17 (to be described later). Thus, the dispenser 10 dispenses the ice made by the ice-making unit.

The dispenser 10 includes a water lever 13 to supply drinking water and an ice lever 11 to supply ice. A control panel 15 is provided in an upper part of the water lever 13 and the ice lever 11 and includes a plurality of selection keys to select ice cubes or shredded ice. The ice duct 17 is formed inside the freezing compartment door 4 and makes an ice discharger (to be described later) to communicate with the dispenser 10.

Figure 4:
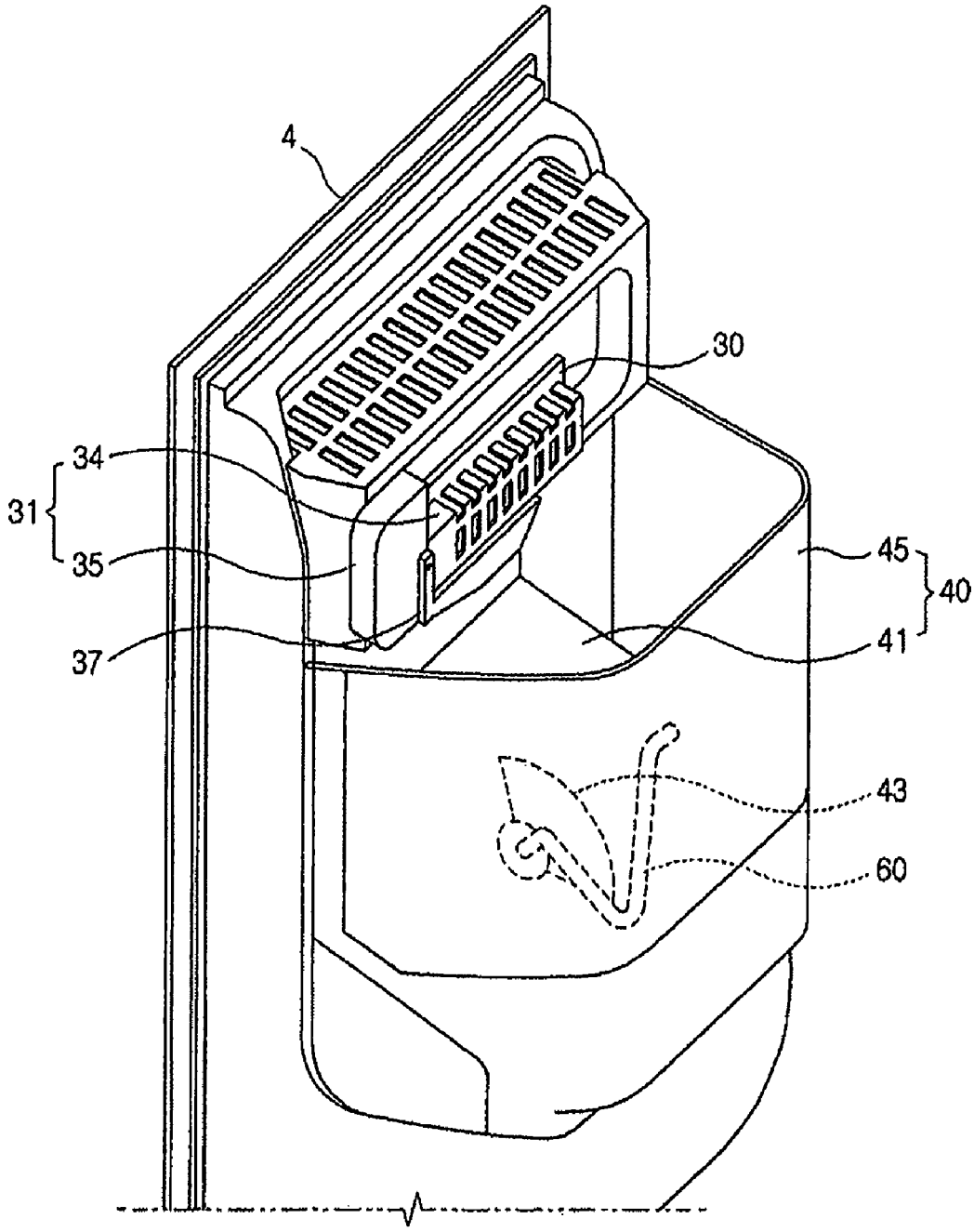
FIG. 4 is a perspective view of a freezing compartment door of a refrigerator according to a first embodiment of the present invention.
Figure 5:
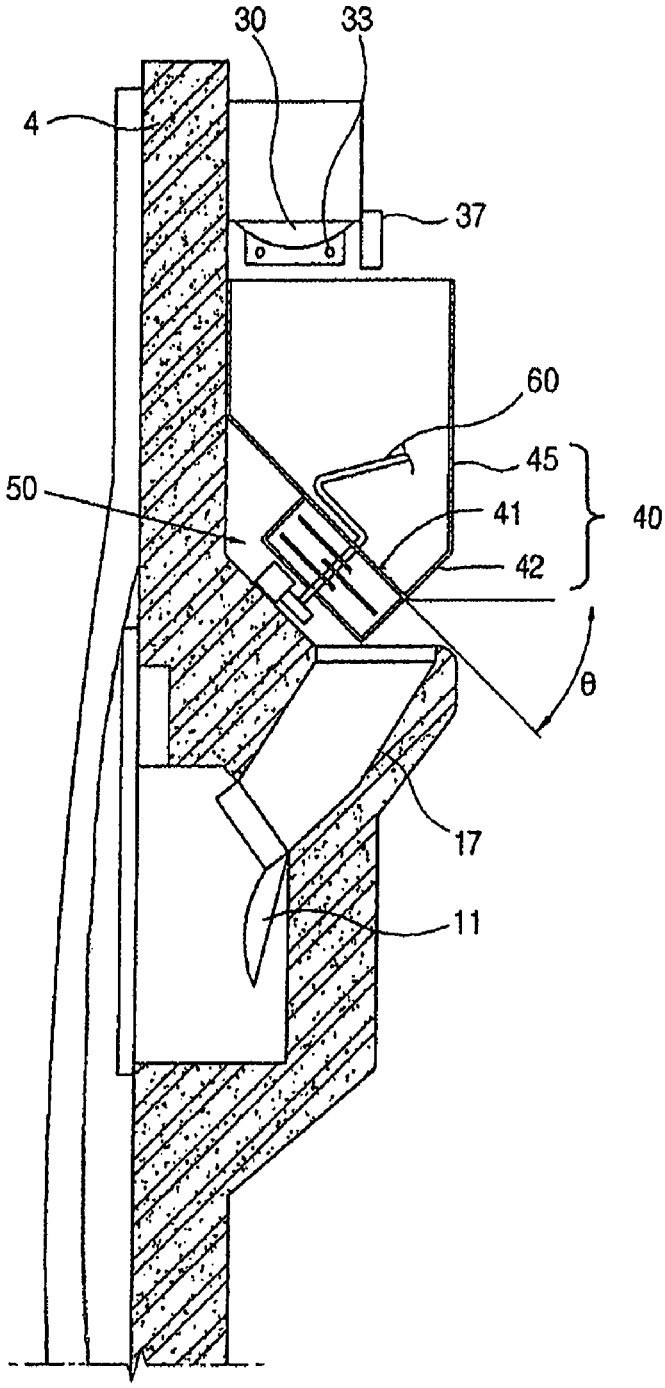
FIG. 5 is a sectional view of the freezing compartment door of the refrigerator according to the first embodiment of the present invention.

Turning to FIG. 4, the ice-making unit includes an ice tray 30 which makes ice cubes, an ice storage container 40 which stores the ice cubes made by the ice tray 30, and an ice shredder 50 (as shown in FIG. 5) which shreds the ice cubes discharged from the ice storage container 40 into pieces.

The ice tray 30 receives water from an external water supplier (not shown) to make the ice cubes. The shape of the ice cube is determined by the shape of the ice tray 30. More specifically, according to the shape of the ice tray 30, ice cubes which have a hemispheric, crescent or hexagonal shape are made. The ice tray 30 may be provided in an inner upper part of the freezing compartment door 4. In the first embodiment of the present invention, the ice tray 30 is provided transversely, if seen from the front, as shown in FIG. 4. The ice tray 30 includes an ice separator 31 which separates the ice cubes made by the ice tray 30 and a full ice detecting lever 37 which detects whether the ice storage container 40 is full of the ice cubes.

The ice separator 31 includes a heater 33 (shown in FIG. 5) which is provided under the ice tray 30 and heats the ice cubes made by the ice tray 30, an ejector 34 which separates the ice cubes heated by the heater 33, and an ice separating motor 35 which supplies a rotation force to the ejector 34. The ice cubes that are separated from the ice tray 30 by the ice separator 31 are stored in the ice storage container 40 provided under the ice tray 30. The ice separator 31 according to the present embodiments employs an ejecting type separator, but is not limited thereto. Alternatively, the ice separator 31 according to the present embodiments may employ a known twisting type of ice separator.

The ice storage container 40 is provided under the ice tray 30, and receives and stores the ice cubes separated from the ice try 30. The ice storage container 40 according to the first embodiment has a rectangular shape. Alternatively, the shape of the ice storage container 40 may be formed in any of a variety of shapes.

The ice storage container 40 shaped like a rectangular container has an open upper part. Thus, the ice storage container 40 receives the ice cubes which fall free from the ice tray 30 by operation of the ice separator 31. The ice storage container 40 includes a rear wall surface 41 as a bottom and a front side 45 which forms an accommodation space of the ice cubes together with a bottom surface 42.

An ice outlet 43 is provided in the rear wall surface 41 of the ice storage container 40 to discharge the ice cubes stored in the ice storage container 40. Here, the rear wall surface 41 of the ice storage container 40 is inclined. More specifically, the rear wall surface 41 of the ice storage container 40 is inclined at an angle of inclination E from a level surface as shown in FIG. 5. The amount of the ice cubes discharged through the ice outlet 43 is determined by the angle of inclination θ. The angle of inclination θ is determined during a production process of the refrigerator. The larger the angle of inclination θ is, the smaller the amount of the ice cubes which are discharged through the ice outlet 43. The smaller the angle of inclination θ is, the greater the amount of the ice cubes which are discharged through the ice outlet 43. In the first embodiment, the angle of inclination θ is between approximately 20° to 60° from the level surface, and preferably about 45° therefrom.

The rear wall surface 41 of the ice storage container 40 may be bent from a bottom part of the ice outlet 43, which is inclined. That is, if the width of the ice storage container 40 is small, the ice outlet 43 is provided in a rear part of the rear wall surface 41 of the ice storage container 40. If the width of the ice storage container 40 is large, a front part of the rear wall surface 41 of the ice storage container 40 is downwardly inclined to the ice outlet 43. The rear part of the ice outlet 43 may be bent to be level or upwardly inclined to the freezing compartment, as shown in FIG. 5. Thus, a uniform amount of the ice cubes stored in the ice storage container 40 is smoothly discharged through the ice outlet 43. The ice shredder 50 is provided in an outer surface of the ice outlet 43 to shred the ice cubes discharged from the ice storage container 40 into pieces.

Figure 6:
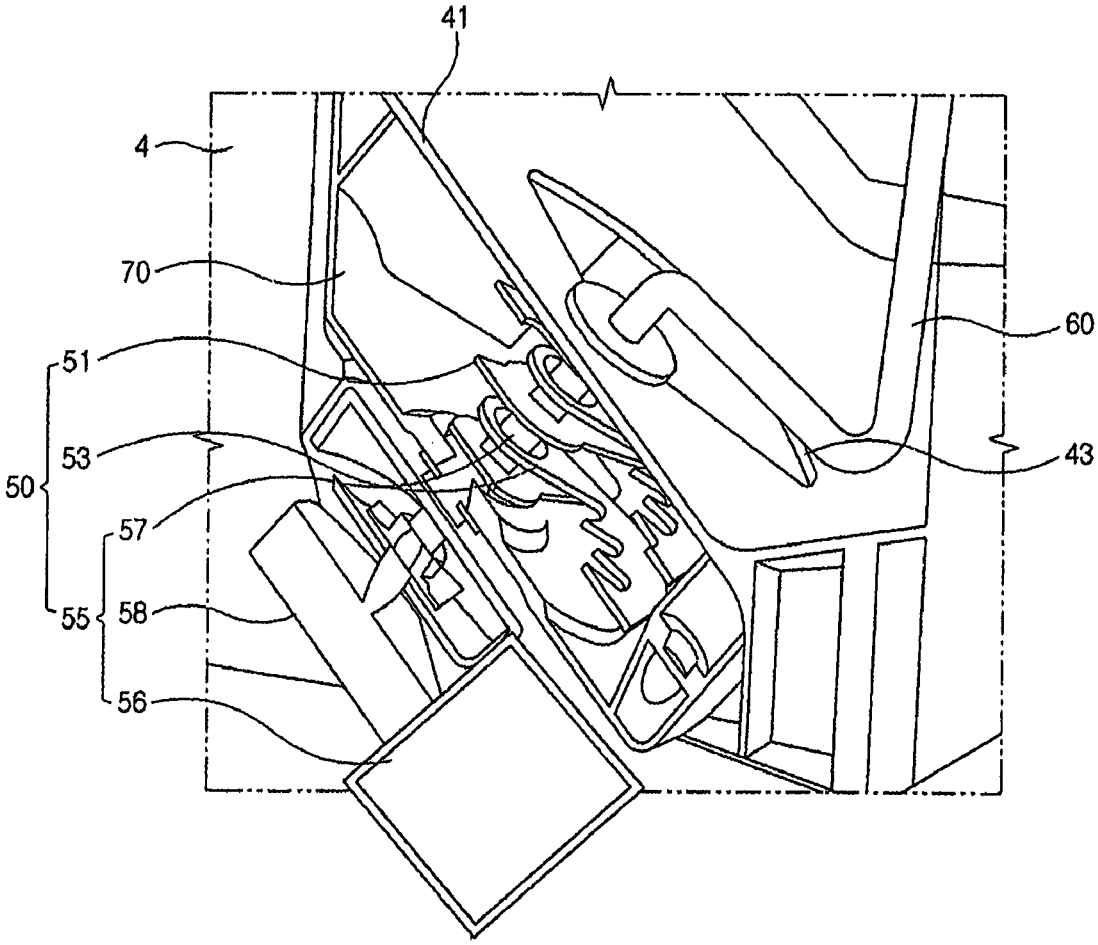
FIG. 6 is a partial perspective view of main parts of the refrigerator according to the first embodiment of the present invention.

The ice shredder 50 includes at least one rotating blade 51, as shown in FIG. 6, which rotatingly moves the ice cubes discharged through the ice outlet 43, a supporting blade 53 which shreds the ice cubes pressedly moved by the rotating blade 51 together with the rotating blade 51, and a driver 55 which supplies a rotation force to the rotating blade 51. The driver 55 includes a driving motor 56, and a rotating shaft 57 which transmits the rotation force of the driving motor 56 to the rotating blade 51.

The rotating blade 51 is rotatably coupled with the rotating shaft 57 and rotates to pressingly move the ice cubes from the ice outlet 43 to the supporting blade 53. The rotating blade 51 may include a plurality of sharp teeth to shred the ice cubes easily.

The number of rotating blades 51 may vary as necessary. There may be provided a single rotating blade 51, or plural rotating blades 51. If a plurality of rotating blades 51 is provided, the respective rotating blades 51 may be disposed in parallel with each other or form a predetermined angle with respect to each other.

The rotating blade 51 may include a plurality of blades which form the equivalent angle with each other. The number of the blades may vary. In the first embodiment, the rotating blade 51 includes three blades. The angle between the respective blades of the rotating blade 51 is not limited, but is preferably the same.

The supporting blade 53 is provided to alternate with the rotating blade 51 within a radius of rotation of the rotating blade 51, not to affect the rotation of the rotating blade 51. That is, if a plurality of plate surfaces of the rotating blade 51 is provided and parallelly-spaced from each other, the supporting blade 53 is provided alternately between the plate surfaces of the plurality of the rotating blades 51. Thus, the supporting blade 53 does not affect the rotation of the rotating blade 51. If the rotating blade 51 rotates, the supporting blade 53 shreds the ice cubes moved by the rotating blade 51 into pieces by using the rotation force of the rotating blade 51.

The supporting blade 53 may include a plurality of sharp teeth in the side facing the ice cubes. The number of the supporting blades 53 may vary as necessary.

The supporting blade 53 and the rotating blade 51 may have various shapes. The supporting blade 53 and the rotating blade 51 may be shaped like a bar which extends downward from the rotating shaft 57. In the first embodiment, the supporting blade 53 and the rotating blade 51 have an "L" shape, which is bent as shown in FIG. 6. With such a shape of the supporting blade 53 and the rotating blade 51, the rotation force of the rotating blade 51 is efficiently supported when the ice cubes are discharged, thereby improving the shredding force of the supporting blade 53 and the rotating blade 51. Also, peripheral components may be less affected by a shrinking support.

The supporting blade 53 and the rotating blade 51 may be in parallel with the inclined rear wall surface 41 of the ice storage container 40. Thus, a dead space of the freezing compartment and the freezing compartment door 4 decreases, thereby enhancing the capacity of the ice storage container 40 and the freezing compartment.

As described above, the driver 55 includes the driving motor 56 and the rotating shaft 57 which transmits the rotation force of the driving motor 56 to the rotating blade 51. A gear assembly 58 which includes a plurality of gears may be provided between the driving motor 56 and the rotating shaft 57.

The gear assembly 58 includes at least one gear, and reduces a speed of the rotation force of the driving motor 56. The gear assembly 58 transmits the rotation force of the driving motor 56 to the rotating blade 51. The gear assembly 58 is provided under the rotating blade 51, and in parallel with the inclined rear wall surface 41 of the ice storage container 40. The driving motor 56 may be provided in a lateral side of the gear assembly 58. The driving motor 56 may be in parallel with the inclined rear wall surface 41 of the ice storage container 40. Then, spatial efficiency of the freezing compartment door 4 and the freezing compartment may be maximized by the driver 55.

The ice-making unit of the refrigerator according to the first embodiment further includes a shaking lever 60 which extends from the rotating shaft 57 to the inside of the ice storage container 40, and rotates to shake the ice cubes stored in the ice storage container 40. The shaking lever 60 is bent and extends from the rotating shaft 57. The shaking lever 60 rotates together with the rotating blade 51 as the shaking lever 60 is connected with the rotating shaft 57. The shaking lever 60 extends from the rotating shaft 57, is bent to be in parallel with the inclined rear wall surface 41 of the ice storage container 40 at a position above the inclined rear wall surface 41 and then is bent again upward from where the lateral side of the ice storage container 40 is adjacent. Thus, the ice cubes stored in the ice storage container 40 are prevented from adhering to each other. The shaking lever 60 rotates to move the ice cubes stored in the ice storage container 40 to the ice outlet 43. The shape of the shaking lever 60 is not limited to the foregoing shape. Alternatively, the shaking lever 60 may have a spiral or zigzag shape to shake the ice cubes stored in the ice storage container 40. Thus, the ice cubes stored in the ice storage container 40 are prevented from adhering to each other.

Figure 8A:
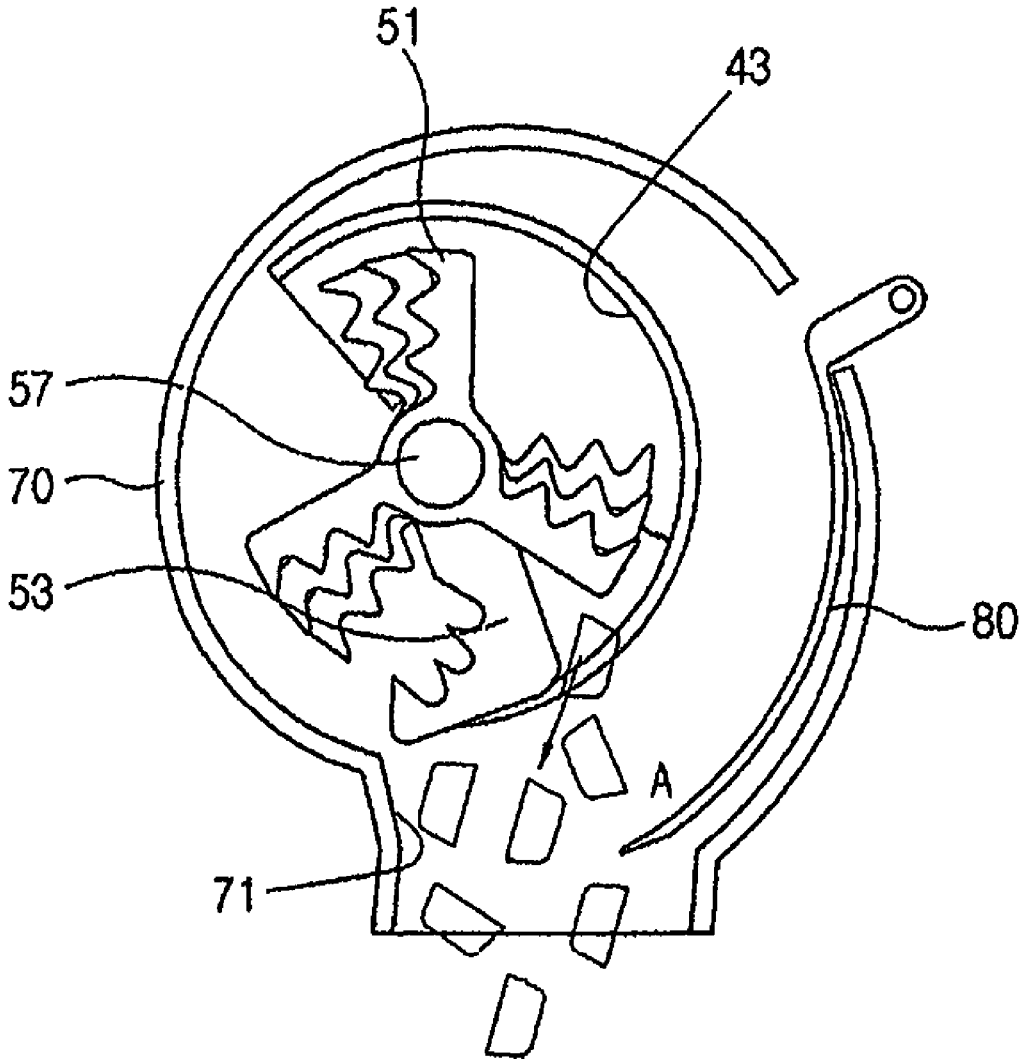
FIG. 8A is an operational view of a discharging lever which is open while discharging ice cubes from the refrigerator according to the embodiments of the present invention.
Figure 8B:
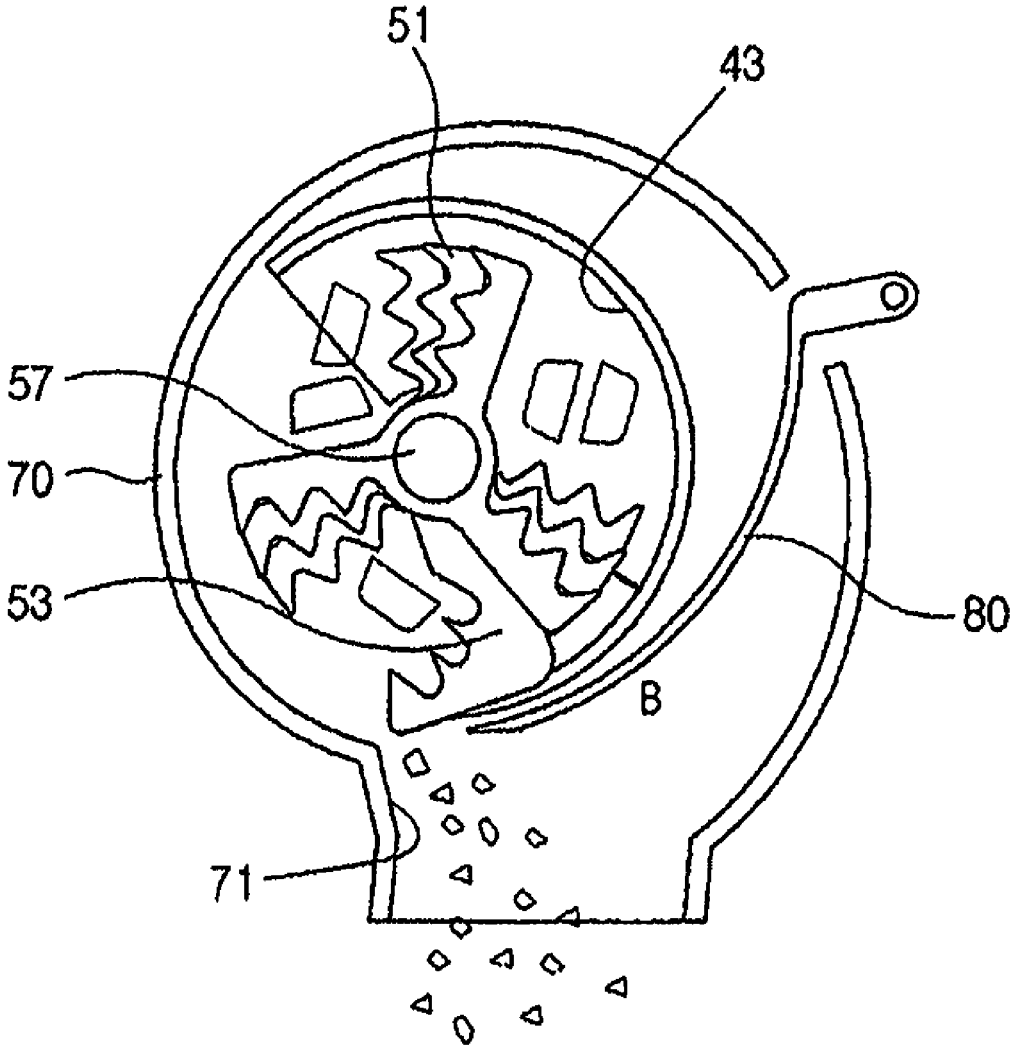
FIG. 8B is an operational view of the discharging lever which is closed while discharging the ice cubes from the refrigerator according to the embodiments of the present invention.

The ice-making unit of the refrigerator according to the first embodiment further includes a blade accommodator 70 which accommodates the rotating blade 51 and the supporting blade 53, and, as shown in FIGS. 8A and 8B, has an ice discharging opening 71 of which one side is open, a discharging lever 80 which is rotatably provided in the blade accommodator 70 and opens and closes the ice discharging opening 71, and a lever driver (not shown) which drives the discharging lever 80.

The ice discharging opening 71 is provided in the blade accommodator 70 to directly discharge the ice cubes discharged by the ice outlet 43 of the ice storage container 40 or discharge ice shredded by the rotating blade 51 and the supporting blade 53. The ice discharging opening 71 communicates with the ice duct 17 of the dispenser 10 (to be described later).

The discharging lever 80 opens and closes the ice discharging opening 71. A first end of the discharging lever 80 is provided to be rotatably connected with the blade accommodator 70. The discharging lever 80 may have a cantilever shape. The blade accommodator 70 and the discharging lever 80 may be in parallel with the inclined rear wall surface 41 of the ice storage container 40. Then, the ice shredded by the rotating blade 51 and the supporting blade 53 is discharged along an inclined bottom of the blade accommodator 70 to the ice discharging opening 71 by the weight of the ice.

The discharging lever 80 restrains the ice discharging opening 71 at a closing position B (refer to FIG. 8B), maintaining an interval relatively smaller than the ice cube being discharged. The ice shredded by the rotating blade 51 and the supporting blade 53 is discharged through the interval.

The lever driver (not shown) drives the discharging lever 80. The lever driver rotates at a predetermined angle so that the discharging lever 80 moves between an opening position A opening the ice discharging opening 71 and the closing position B closing the ice discharging opening 71. The lever driver rotates the discharging lever 80 to the opening position A opening the ice discharging opening 71 if a user selects the discharge of ice as ice cubes from the control panel 15 of the dispenser 10 and presses the ice lever 11. The lever driver does not rotate the discharging lever 80 to thereby keep the discharging level 80 in the closing position B closing the ice discharging opening 71 if a user selects the discharge of ice as shredded ice from the control panel 15 of the dispenser 10 and presses the ice lever 11.

In the first embodiment, the rear wall surface 41 of the ice storage container 40 is downwardly inclined to the storage compartment, but is not limited thereto. Alternatively, the rear wall surface 41 of the ice storage container 40 may be downwardly inclined to the outside.

Hereinafter, a process of supplying ice of the refrigerator according to the first embodiment will be described with relation to the drawings.

An operation of discharging the ice cubes will be described with reference to FIGS. 3 to 6 and 8A.

The ice tray 30 receives water from an external water supplier and makes ice cubes. The ice cubes are separated from the ice tray 30 by the ice separator 31 and stored in the ice storage container 40. If the full ice detecting lever 37 detects that the ice storage container 40 is full of the ice cubes while repeating the ice-making operation, the ice tray 30 stops making the ice cubes.

The driving motor 56 rotates if a user selects the discharge of ice as ice cubes from the control panel 15 and presses the ice lever 11. Corresponding to the rotation of the driving motor 56, the shaking lever 60 and the rotating blade 51 rotate. The ice cubes stored in the ice storage container 40 fall freely through the ice outlet 43 and move to the blade accommodator 70.

The lever driver rotates the discharging lever 80 to the opening position A opening the ice discharging opening 71. The ice cubes accommodated in the blade accommodator 70 are discharged to the outside through the ice discharging opening 71 and the ice duct 17.

An operation of discharging the shredded ice will be described with reference to FIGS. 3 to 6 and 8B.

The driving motor 56 rotates if a user selects the discharge of ice as shredded ice from the control panel 15 and presses the ice lever 11. Corresponding to the rotation of the driving motor 56, the shaking lever 60 and the rotating blade 51 rotate. The ice cubes stored in the ice storage container 40 fall freely through the ice outlet 43 and move to the blade accommodator 70.

The lever driver makes the discharging lever 80 remain in the closing position B closing the ice discharging opening 71. Then, the rotating blade 51 pressingly moves the ice cubes to the supporting blade 53 to be shredded into pieces. The shredded ice is discharged through a space between the blade accommodator 70 and the discharging lever 80, and is then moved to the outside through the ice duct 17.

Figure 7:
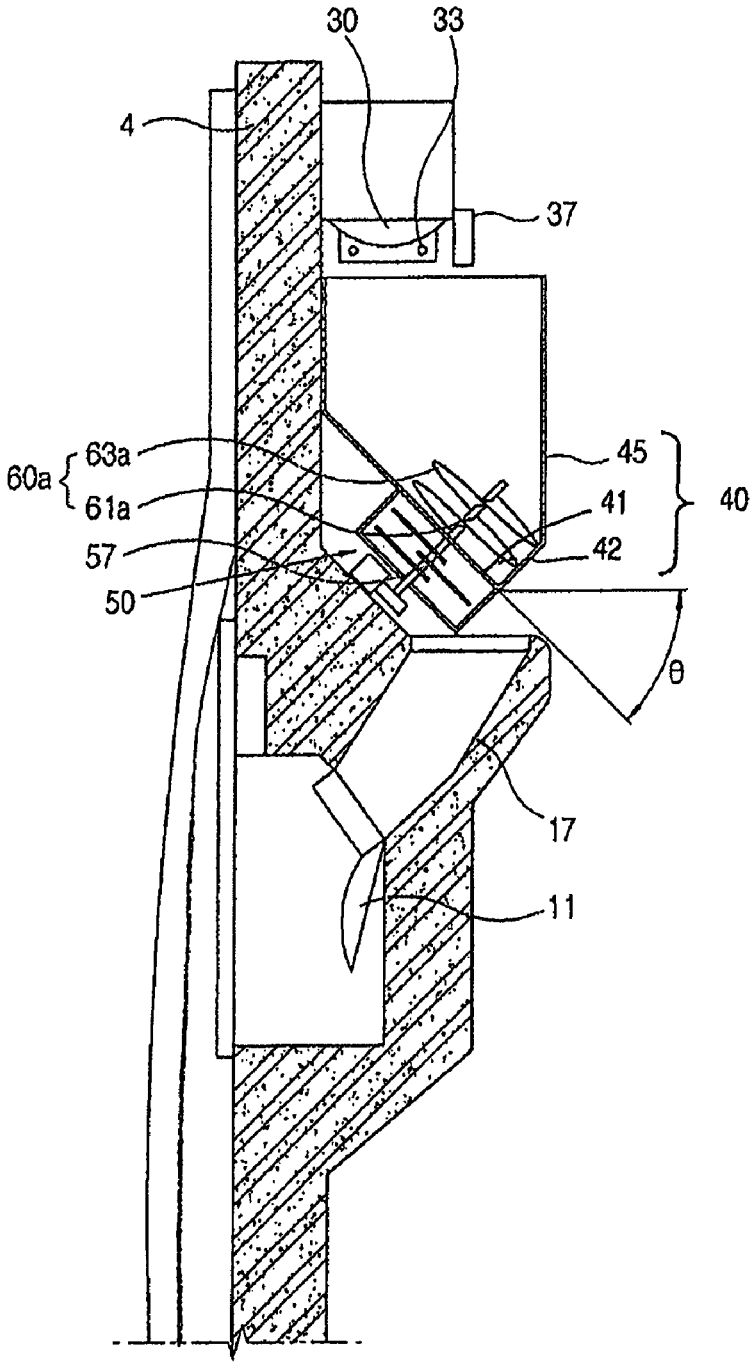
FIG. 7 is a sectional view of a freezing compartment door of a refrigerator according to a second embodiment of the present invention.

Hereinafter, a refrigerator according to a second embodiment will be described with reference to FIG. 7.

In the second embodiment, an ice mover 60*a* replaces the shaking lever 60 of the refrigerator according to the first embodiment.

The ice mover 60*a* moves ice cubes stored in an ice storage container 40 to an ice outlet 43 (refer to FIG. 4). The ice mover 60*a* includes a moving rotation shaft 61*a* which extends from a rotating shaft 57, and a spiral blade 63*a* which has a spiral shape and is formed along a circumference of the moving rotation shaft 61*a*.

The moving rotation shaft 61*a* extends from the rotating shaft 57 and is vertically provided with respect to an inclined rear wall surface 41 of the ice storage container 40.

The spiral blade 63*a* is spirally formed in a lengthwise direction of the moving rotation shaft 61*a*. The spiral blade 63*a* rotates corresponding to a driving of a driver 55 (refer to FIG. 6) and pressingly moves the ice cubes stored in the ice storage container 40 to the ice outlet 43 (refer to FIG. 4). That is, the ice cubes stored in the ice storage container 40 are transferred to the ice outlet 43. Then, the ice cubes stored in the ice storage container 40 are discharged easily, and the amount of the discharged ice is uniform.

As described above, the refrigerator according to the present embodiments decreases the dead space of the freezing compartment and the freezing compartment door 4 to improve the spatial efficiency thereof and increases the capacity of the ice storage container 40 by providing the inclined rear wall surface 41 of the ice storage container 40.

As the rotating blade 51, the supporting blade 53 and the blade accommodator 70 are in parallel with the rear wall surface 41 of the ice storage container 40, the dead space of the freezing compartment door 4 is efficiently used and the capacity of the ice storage container 40 increases. The ice cubes and shredded ice fall freely by gravity, thereby making the amount of ice supplied to the dispenser 10 uniform. Also, the shredded ice does not pile up in the blade accommodator 70.

As described above, the present embodiments provide a refrigerator which uses a dead space of a storage compartment to improve spatial efficiency of the storage compartment, increases a capacity of an ice storage container and makes the amount of ice supplied to a dispenser uniform.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator, comprising:

a main body cabinet forming a storage compartment;

a door operable to open and close the storage compartment;

an ice tray provided in the refrigerator capable of making ice cubes;

an ice storage container receiving the ice cubes made by the ice tray, and having an ice outlet formed in a lower part thereof and a rear wall surface forming an angle of inclination with respect to a level surface, the ice outlet being defined through the rear wall surface of the ice storage container;

at least one rotating blade rotatingly moving the ice cubes discharged to the ice outlet;

a supporting blade shredding the ice cubes moved by the rotating blade, in cooperation with the at least one rotating blade; and wherein the rotating blade and the supporting blade are provided in parallel with the inclined rear wall surface of the ice storage container.

2. The refrigerator according to claim 1, wherein the angle of inclination ranges from 20° to 60°.

3. The refrigerator according to claim 2, wherein the rear wall surface of the ice storage container is downwardly inclined to the ice outlet.

4. The refrigerator according to claim 1, further comprising:

A driver including a gear assembly having a rotating shaft connected with a lower part of the at least one rotating blade and transmitting a driving force to the rotating blade, and a driving motor provided in a side of the gear assembly and supplying a driving force to the gear assembly.

5. The refrigerator according to claim 1, further comprising a shaking lever bent from the rotating shaft and extending inside of the ice storage container, and shaking the ice cubes stored in the ice storage container.

6. The refrigerator according to claim 1, further comprising an ice mover connected with the rotating shaft and moving the ice cubes stored in the ice storage container to the ice outlet.

7. The refrigerator according to claim 6, wherein the ice mover comprises a moving rotation shaft extending from the rotating shaft, and a spiral blade spirally formed along a circumference of the moving rotation shaft.

8. The refrigerator according to claim 5, further comprising:

a blade accommodator accommodating the rotating blade and the supporting blade, and having an ice discharging opening having a first side that is open; and a discharging lever rotatably provided in the blade accommodator and opening and closing the ice discharging opening.

9. The refrigerator according to claim 6, further comprising:

a blade accommodator accommodating the rotating blade and the supporting blade, and having an ice discharging opening having a first side that is open; and a discharging lever rotatably provided in the blade accommodator and opening and closing the ice discharging opening.

10. The refrigerator according to claim 8, wherein the blade accommodator and the discharging lever are provided in parallel with the inclined rear wall surface of the ice storage container.

11. The refrigerator according to claim 9, wherein the blade accommodator and the discharging lever are provided in parallel with the inclined rear wall surface of the ice storage container.

12. An ice providing device, comprising:

an ice making device making ice cubes; and an ice storage container receiving the ice cubes made by the ice making device, the ice storage container having an ice outlet formed in a lower part of the ice storage container and a rear wall surface of the ice storage container and having an angle of inclination with respect to a level surface, the ice outlet being defined through the rear wall surface of the ice storage container; and an ice moving device moving ice provided at the lower part of the inclined rear wall surface of the ice storage container to the ice outlet, wherein the ice moving device is a shaking lever connected to a shaft extending beneath the ice outlet, the shaking lever including a first part bent from the shaft and extending parallel to the bottom surface and a second part bent from the first part and extending upward from the first part.

13. The ice providing device according to claim 12, further comprising an ice shredder receiving and shredding the ice provided from the ice outlet.

14. An ice providing device, comprising:

an ice making device making ice cubes;

an ice storage container receiving the ice cubes made by the ice making device, the ice storage container having an ice outlet formed in a lower part of the ice storage container and a rear wall surface of the ice storage container and having an angle of inclination with respect to a level surface, the ice outlet being defined through the rear wall surface of the ice storage container; and an ice moving device moving ice provided at the lower part of the inclined rear wall surface of the ice storage container to the ice outlet, wherein the ice moving device includes a shaft extending from beneath the ice outlet into the ice storage container and a spiral blade spirally formed along a circumference of the shaft.

* * * * *

UNITED STATES PATENT AND TRADEMARK OFFICE

CERTIFICATE OF CORRECTION

PATENT NO. : 7,797,961 B2
APPLICATION NO. : 11/898051
DATED : September 21, 2010
INVENTOR(S) : Jae-koog An et al.

It is certified that error appears in the above-identified patent and that said Letters Patent is hereby corrected as shown below:

Column 9, Line 28, claim 4 delete "A" and insert -- a --, therefor.

Column 10, Line 16 claim 13 after "cubes;" delete "and".

Signed and Sealed this

Thirtieth Day of November, 2010

David J. Kappos

David J. Kappos
*Director of the United States Patent and Trademark Office*